US011802486B2

(12) United States Patent
Dunn et al.

(10) Patent No.: US 11,802,486 B2
(45) Date of Patent: Oct. 31, 2023

(54) CMC COMPONENT AND FABRICATION USING MECHANICAL JOINTS

(71) Applicant: General Electric Company, Schenectady, NY (US)

(72) Inventors: Daniel Gene Dunn, Guilderland, NY (US); Douglas Decesare, Queensbury, NY (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 15/810,874

(22) Filed: Nov. 13, 2017

(65) Prior Publication Data

US 2019/0145270 A1 May 16, 2019

(51) Int. Cl.
*F01D 9/04* (2006.01)
*F01D 5/28* (2006.01)

(52) U.S. Cl.
CPC ..... *F01D 9/04* (2013.01); *F01D 5/282* (2013.01); *F01D 9/041* (2013.01);
(Continued)

(58) Field of Classification Search
CPC ..... F05D 2300/6033; F05D 2260/36; F05D 2230/23; F05D 2230/60; F01D 9/04; F01D 5/282; F01D 25/005
See application file for complete search history.

(56) References Cited

U.S. PATENT DOCUMENTS 5,506,018 A 4/1996 Jacob et al.
6,357,194 B1 * 3/2002 Jones, Jr. ..... F16B 12/125 52/592.1

(Continued)

FOREIGN PATENT DOCUMENTS

CN 103601523 A 2/2014

OTHER PUBLICATIONS

Messier, Robert W., Jr.. (2004). Joining of Materials and Structures—From Pragmatic Process to Enabling Technology. Elsevier. p. 161-163.*

(Continued)

*Primary Examiner* — Jennifer A Gillett
(74) *Attorney, Agent, or Firm* — Dority & Manning, P.A.

(57) ABSTRACT

A ceramic matrix composite (CMC) component including a first subcomponent and a second subcomponent. The first component formed of a ceramic matrix composite (CMC) including reinforcing fibers embedded in a matrix and the second CMC subcomponent formed of one of a ceramic matrix composite (CMC) including reinforcing fibers embedded in a matrix or a monolithic ceramic material. The subcomponents further including an interlocking mechanical joint joining the first subcomponent and the second subcomponent to form the composite material component. The interlocking mechanical joint including at least one groove defined in one of the first subcomponent or the second subcomponent and into which a portion of the other of the first subcomponent or the second subcomponent is disposed. A shroud segment is provided formed of the joined first and second subcomponents. Methods are also provided for joining the first and second subcomponents using an interlocking mechanical joint.

17 Claims, 9 Drawing Sheets

(52) U.S. Cl.
CPC ..... *F05D 2220/32* (2013.01); *F05D 2230/23* (2013.01); *F05D 2230/60* (2013.01); *F05D 2260/36* (2013.01); *F05D 2300/6033* (2013.01)

(56) References Cited

U.S. PATENT DOCUMENTS

| | | | | |
|---|---|---|---|---|
| 6,648,597 | B1 * | 11/2003 | Widrig | F01D 9/044 415/200 |
| 7,247,212 | B2 | 7/2007 | Kostar et al. | |
| 7,963,038 | B2 | 6/2011 | Schmitz | |
| 8,079,807 | B2 | 12/2011 | Shapiro et al. | |
| 8,398,374 | B2 | 3/2013 | Roberts et al. | |
| 8,956,112 | B2 | 2/2015 | Tanahashi et al. | |
| 8,961,059 | B2 | 2/2015 | Reeves et al. | |
| 9,132,619 | B2 | 9/2015 | Khalifa et al. | |
| 9,151,166 | B2 | 10/2015 | Uskert | |
| 9,175,571 | B2 | 11/2015 | Floyd | |
| 9,267,388 | B2 | 2/2016 | Mizokami et al. | |
| 9,291,060 | B2 | 3/2016 | Lazur | |
| 9,440,888 | B2 | 9/2016 | Bouillon et al. | |
| 9,527,262 | B2 | 12/2016 | Zhang et al. | |
| 9,528,378 | B2 | 12/2016 | Mateo et al. | |
| 9,546,562 | B2 | 1/2017 | Hillier | |
| 10,087,784 | B2 | 10/2018 | Shapiro et al. | |
| 10,202,853 | B2 | 2/2019 | Kleinow | |
| 10,253,639 | B2 | 4/2019 | Sippel et al. | |
| 10,989,060 | B2 | 4/2021 | Vetters et al. | |
| 2005/0254942 | A1 | 11/2005 | Morrison et al. | |
| 2006/0120874 | A1 | 6/2006 | Burke et al. | |
| 2006/0162277 | A1 * | 7/2006 | Schultz | F16B 12/125 52/741.4 |
| 2006/0182971 | A1 * | 8/2006 | Merrill | C04B 35/80 428/409 |
| 2007/0048144 | A1 * | 3/2007 | Morrison | C04B 41/009 416/224 |
| 2008/0178465 | A1 | 7/2008 | Schiavo et al. | |
| 2009/0324393 | A1 | 12/2009 | Gonzalez et al. | |
| 2010/0251721 | A1 | 10/2010 | Morrison et al. | |
| 2011/0265406 | A1 * | 11/2011 | Morrison | C04B 35/80 52/708 |
| 2012/0177488 | A1 | 7/2012 | Corman | |
| 2012/0237355 | A1 * | 9/2012 | Zhang | F01D 5/147 416/226 |
| 2014/0259665 | A1 * | 9/2014 | Bruck | F01D 5/005 29/889.1 |
| 2014/0277450 | A1 | 9/2014 | Warburton | |
| 2015/0003989 | A1 | 1/2015 | Uskert et al. | |
| 2015/0235314 | A1 | 12/2015 | Davidson et al. | |
| 2015/0345296 | A1 | 12/2015 | Davidson et al. | |
| 2015/0345307 | A1 | 12/2015 | Davidson et al. | |
| 2016/0169033 | A1 | 6/2016 | Weaver et al. | |
| 2016/0325368 | A1 | 11/2016 | Landwehr et al. | |
| 2016/0348521 | A1 | 12/2016 | Sippel et al. | |
| 2016/0348528 | A1 | 12/2016 | Vetters et al. | |
| 2016/0376893 | A1 | 12/2016 | Hardwicke et al. | |
| 2017/0002674 | A1 | 1/2017 | Vetters et al. | |
| 2017/0058684 | A1 | 3/2017 | Correia et al. | |
| 2018/0065337 | A1 | 3/2018 | Grasso et al. | |
| 2018/0105471 | A1 * | 4/2018 | Shi | C04B 35/565 |

OTHER PUBLICATIONS

Brun, Milivoj K., Formation of Tough Composite Joints, Journal of the American Ceramic Society, Dec. 1998, vol. 81, No. 12, pp. 3307-3312.

Corman, G. S., & Luthra, K. L., Melt Infiltrated Ceramic Composites (HiperComp) for Gas Turbine Engine Applications, Jan. 2006, Continuous Fiber Ceramic Composites Program Phase II Final Report for the Period May 1994-Sep. 2005, Chapter 3.3 Composite Joining, pp. 97-115.

* cited by examiner

CMC COMPONENT AND FABRICATION USING MECHANICAL JOINTS

BACKGROUND

The subject matter disclosed herein relates to ceramic matrix composite (CMC) subcomponents and the joining of such subcomponents. More particularly, this invention is directed to a CMC component and method of forming the CMC component from multiple subcomponents, utilizing mechanical joints.

Gas turbine engines feature combustors as components. Air enters the engine and passes through a compressor. The compressed air is routed through one or more combustors. Within a combustor are one or more nozzles that serve to introduce fuel into a stream of air passing through the combustor. The resulting fuel-air mixture is ignited in the combustor by igniters to generate hot, pressurized combustion gases in the range of about 1100° C. to 2000° C. and this high energy airflow exiting the combustor is redirected by the first stage turbine nozzle to downstream high and low pressure turbine stages. The turbine section of the gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding the high energy airflow produced by combustion of fuel-air mixture. Gas turbine buckets or blades generally have an airfoil shape designed to convert the thermal and kinetic energy of the flow path gases into mechanical rotation of the rotor. In these stages, the expanded hot gases exert forces upon turbine blades, thus providing additional rotational energy, for example, to drive a power-producing generator.

In advanced gas path (AGP) heat transfer design for gas turbine engines, the high temperature capability of CMCs make it an attractive material from which to fabricate the arcuate components, such as turbine blades, nozzles and shrouds. Within a turbine engine, a shroud is a ring of material surrounding the rotating blades.

A number of techniques have been used in the past to manufacture turbine engine components, such as the turbine blades, nozzles or shrouds using ceramic matrix composites (CMC). CMC materials generally comprise a ceramic fiber reinforcement material embedded in a ceramic matrix material. The reinforcement material serves as the load-bearing constituent of the CMC in the event of a matrix crack, while the ceramic matrix protects the reinforcement material, maintains the orientation of its fiber, and carries load in the absence of matrix cracks. Of particular interest to high-temperature applications, such as in a gas turbine engine, are silicon-based composites. Silicon carbide (SiC)-based ceramic matrix composite (CMC) materials have been proposed as materials for certain components of gas turbine engines, such as the turbine blades, vanes, combustor liners, and shrouds. SiC fibers have been used as a reinforcement material for a variety of ceramic matrix materials, including SiC, C, and $Al_2O_3$. Various methods are known for fabricating SiC-based CMC components, including Silicomp, melt infiltration (MI), chemical vapor infiltration (CVI), polymer infiltration and pyrolysis (PIP). In addition to non-oxide based CMCs such as SiC, there are oxide based CMCs. Though these fabrication techniques significantly differ from each other, each involves the fabrication and densification of a preform to produce a part through a process that includes the application of heat at various processing stages.

Of particular interest in the field of CMCs is the joining of one CMC subcomponent, or preform, to another CMC or ceramic subcomponent to form a complete component structure. For instance, the joining of one CMC subcomponent to another may arise when the shape complexity of an overall complete structure may be too complex to lay-up as a single part. Another instance where joining of one CMC subcomponent to another may arise is when a large complete structure is difficult to lay-up as a single part, and multiple subcomponents, or preforms, are manufactured and joined to form the large complete structure. Fabrication of complex composite components may require complex tooling, and may involve forming fibers over small radii, both of which lead to challenges in manufacturability. Current procedures for bonding CMC subcomponents include, but are not limited to, diffusion bonding, reaction forming, melt infiltration, brazing, adhesives, or the like. Of particular concern in these CMC component structures that are formed of conjoined subcomponents is the separation, or failure, of the joint that is formed during the joining procedure, when under the influence of applied loads.

Thus, for woodworking type joints that may be limited by the interlaminar properties of the CMC, an improved joint and method of joining one CMC subcomponent, or preform, to another ceramic monolithic subcomponent or CMC subcomponent to form a complete structure is desired. The resulting joint providing strength and toughness to the structure.

BRIEF DESCRIPTION

Various embodiments of the disclosure include a ceramic composite material component and fabrication using mechanical joints. In accordance with one exemplary embodiment, disclosed is a ceramic composite material component including a first subcomponent comprised of a ceramic matrix composite (CMC) including reinforcing fibers embedded in a matrix, a second subcomponent comprised of one of a ceramic matrix composite (CMC) including reinforcing fibers embedded in a matrix or a ceramic monolithic material and at least one interlocking mechanical joint joining the first subcomponent and the second subcomponent to form the ceramic composite material component. The at least one interlocking mechanical joint comprises at least one groove defined in one of the first subcomponent or the second subcomponent and into which a portion of the other of the first subcomponent or the second subcomponent is disposed.

In accordance with another exemplary embodiment, disclosed is a shroud segment for a gas turbine including a first CMC subcomponent comprised of a ceramic matrix composite (CMC) including a plurality of reinforcing fibers embedded in a matrix, a second CMC subcomponent comprised of a ceramic matrix composite (CMC) including reinforcing fibers embedded in a matrix and an interlocking mechanical joint joining the first CMC subcomponent and the second CMC subcomponent to form the shroud segment. The plurality of reinforcing fibers of the first CMC subcomponent are oriented substantially along a length of the first CMC subcomponent. The plurality of reinforcing fibers of the second CMC component are oriented substantially along a length of the second CMC subcomponent. The interlocking mechanical joint comprises at least one groove defined in one of the first CMC subcomponent or the second CMC subcomponent and into which a portion of the other of the first CMC subcomponent or the second CMC subcomponent is disposed in a manner to orient the reinforcing fibers of the first CMC subcomponent substantially orthogonal to the reinforcing fibers of the second CMC subcomponent.

In accordance with yet another exemplary embodiment, disclosed is a method of forming a ceramic matrix composite (CMC) component including providing a first CMC subcomponent comprised of a ceramic matrix composite (CMC) including reinforcing fibers embedded in a matrix, providing a second CMC subcomponent comprised of a ceramic matrix composite (CMC) including reinforcing fibers embedded in a matrix and mechanically joining the first CMC subcomponent and the second CMC subcomponent at an interlocking mechanical joint, in a manner to orient the reinforcing fibers of the first CMC subcomponent substantially orthogonal to the reinforcing fibers of the second CMC subcomponent, to form the composite material component. The plurality of reinforcing fibers of the first CMC subcomponent are oriented substantially along a length of the first CMC subcomponent. The plurality of the second CMC subcomponent reinforcing fibers are oriented along a length of the second CMC subcomponent.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
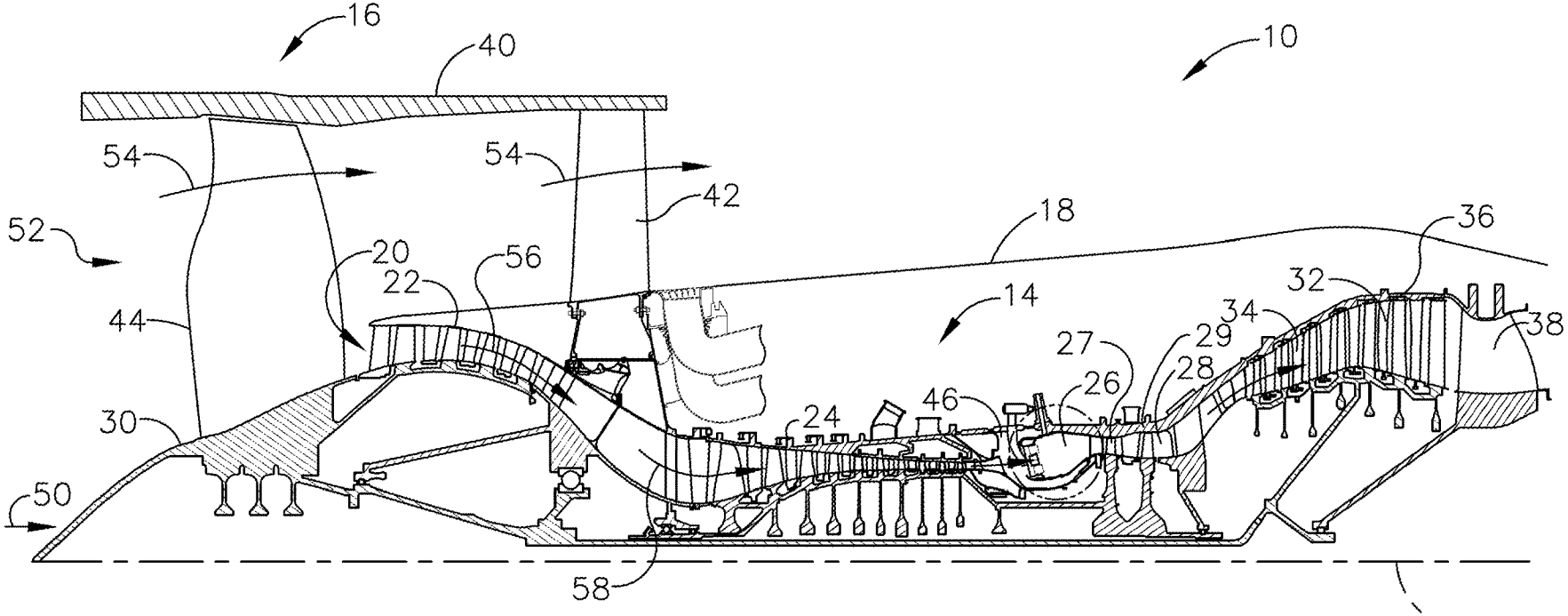
FIG. 1 is a cross sectional illustration of an aviation gas turbine engine, in accordance with one or more embodiments shown or described herein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Approximating language, as used herein throughout the specification and claims, is applied to modify any quantitative representation that could permissibly vary without resulting in a change in the basic function to which it is related. Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by such term is not to be limited to the precise value specified. In at least some instances, the approximating language may correspond to the precision of an instrument for measuring the value. Here and throughout the specification and claims, range limitations are combined and interchanged. Such ranges are identified and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As used herein, ceramic matrix composite or "CMCs" refers to composites comprising a ceramic matrix reinforced by ceramic fibers. Some examples of CMCs acceptable for use herein can include, but are not limited to, materials having a matrix and reinforcing fibers comprising oxides, carbides, nitrides, oxycarbides, oxynitrides and mixtures thereof. Examples of non-oxide materials include, but are not limited to, CMCs with a silicon carbide matrix and silicon carbide fiber (when made by silicon melt infiltration, this matrix will contain residual free silicon); silicon carbide/silicon matrix mixture and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics. Specifically, the oxide-oxide CMCs may be comprised of a matrix and reinforcing fibers comprising oxide-based materials such as aluminum oxide ($Al_2O_3$), silicon dioxide ($SiO_2$), aluminosilicates, and mixtures thereof. Accordingly, as used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, and anisotropic properties as compared to a (non-reinforced) monolithic ceramic structure.

There are several methods that can be used to fabricate SiC—SiC CMCs. In one approach, the matrix is partially formed or densified through melt infiltration (MI) of molten silicon or silicon containing alloy into a CMC preform. In another approach, the matrix is at least partially formed through chemical vapor infiltration (CVI) of silicon carbide into a CMC preform. In a third approach, the matrix is at least partially formed by pyrolizing a silicon carbide yielding pre-ceramic polymer. This method is often referred to as polymer infiltration and pyrolysis (PIP). Combinations of the above three techniques can also be used.

In one example of the MI CMC process, a boron-nitride based coating system is deposited on SiC fiber. The coated fiber is then impregnated with matrix precursor material in order to form prepreg tapes. One method of fabricating the tapes is filament winding. The fiber is drawn through a bath of matrix precursor slurry and the impregnated fiber wound on a drum. The matrix precursor may contain silicon carbide and or carbon particulates as well as organic materials. The impregnated fiber is then cut along the axis of the drum and is removed from the drum to yield a flat prepreg tape where the fibers are nominally running in the same direction. The resulting material is a unidirectional prepreg tape. The prepreg tapes can also be made using continuous prepregging machines or by other means. The tape can then be cut into shapes, layed up, and laminated to produce a preform. The preform is pyrolyzed, or burned out, in order to char any organic material from the matrix precursor and to create porosity. Molten silicon is then infiltrated into the porous preform, where it can react with carbon to form silicon carbide. Ideally, excess free silicon fills any remaining porosity and a dense composite is obtained. The matrix produced in this manner typically contains residual free silicon.

The prepreg MI process generates a material with a two-dimensional fiber architecture by stacking together multiple one-dimensional prepreg plies where the orientation of the fibers is varied between plies. Plies are often identified based on the orientation of the continuous fibers. A zero degree orientation is established, and other plies are designed based on the angle of their fibers with respect to the zero degree direction. Plies in which the fibers run perpendicular to the zero direction are known as 90-degree plies, cross plies, or transverse plies.

The MI approach can also be used with two-dimensional or three-dimensional woven architectures. An example of this approach would be the slurry-cast process, where the fiber is first woven into a three-dimensional preform or into a two cloth. In the case of the cloth, layers of cloth are cut to shape and stacked up to create a preform. A chemical vapor infiltration, CVI, technique is used to deposit the interfacial coatings (typically boron nitride based or carbon based) onto the fibers. CVI can also be used to deposit a layer of silicon carbide matrix. The remaining portion of the matrix is formed by casting a matrix precursor slurry into the preform, and then infiltrating with molten silicon.

An alternative to the MI approach is to use the CVI technique to densify the Silicon Carbide matrix in one-dimensional, two-dimensional or three-dimensional architectures. Similarly, PIP can be used to densify the matrix of the composite. CVI and PIP generated matrices can be produced without excess free silicon. Combinations of MI, CVI, and PIP can also be used to densify the matrix.

The joints described herein can be used to join various CMC materials, such as, but not limited to, Oxide-Oxide CMCs or SiC—SiC CMCs, or to join CMCs to monolithic materials. In the case of SiC—SiC CMCs, the joints can join subcomponents that are all MI based, that are all CVI based, that are all PIP based, or that are combinations thereof. In the case of interlocking joints, there may not be direct bonding of the subcomponents together, or the subcomponents may be bonded by silicon, silicon carbide, a combination thereof, or other suitable material. The bonding material may be deposited as a matrix precursor material that is subsequently densified by MI, CVI, or PIP. Alternatively, the bonding material maybe produced by MI, CVI, or PIP without the use of matrix precursor in the joint. Furthermore, the joints described herein may be formed at any appropriate stage in CMC processing. That is, the subcomponents may be comprised of green prepreg, laminated preforms, pyrolyzed preforms, fully densified preforms, or combinations thereof.

Referring now to the drawings wherein like numerals correspond to like elements throughout, attention is directed initially to FIG. 1 which depicts in diagrammatic form an exemplary gas turbine engine 10 utilized with aircraft having a longitudinal or axial centerline axis 12 therethrough for reference purposes. It should be understood that the principles described herein are equally applicable to turbofan, turbojet and turboshaft engines, as well as turbine engines used for other vehicles or in stationary applications. Furthermore, while a turbine shroud is used as an example, the principles of the present invention are applicable to any low-ductility flowpath component which is at least partially exposed to a primary combustion gas flowpath of a gas turbine engine and formed of a ceramic matrix composite (CMC) material.

Engine 10 preferably includes a core gas turbine engine generally identified by numeral 14 and a fan section 16 positioned upstream thereof. Core engine 14 typically includes a generally tubular outer casing 18 that defines an annular inlet 20. Outer casing 18 further encloses a booster compressor 22 for raising the pressure of the air that enters core engine 14 to a first pressure level. A high pressure, multi-stage, axial-flow compressor 24 receives pressurized air from booster 22 and further increases the pressure of the air. The pressurized air flows to a combustor 26, where fuel is injected into the pressurized air stream to raise the temperature and energy level of the pressurized air. The high energy combustion products flow from combustor 26 to a first (high pressure) turbine 28 for driving high pressure compressor 24 through a first (high pressure) drive shaft, and then to a second (low pressure) turbine 32 for driving booster compressor 22 and fan section 16 through a second (low pressure) drive shaft that is coaxial with first drive shaft. The turbines 28, 32 include a stationary nozzle and a rotor disk downstream of the nozzle that rotates about the centerline axis 12 of the engine 10 and carries an array of airfoil-shaped turbine blades 34. Shrouds 29, 36 comprising a plurality of arcuate shroud segments is arranged so as to encircle and closely surround the turbine blades 27, 34 and thereby define the outer radial flowpath boundary for the hot gas stream flowing through the turbine blades 27, 34. After driving each of turbines 28 and 32, the combustion products leave core engine 14 through an exhaust nozzle 38.

Fan section 16 includes a rotatable, axial-flow fan rotor 30 and a plurality of fan rotor blades 44 that are surrounded by an annular fan casing 40. It will be appreciated that fan casing 40 is supported from core engine 14 by a plurality of substantially radially-extending, circumferentially-spaced outlet guide vanes 42. In this way, fan casing 40 encloses fan rotor 30 and the plurality of fan rotor blades 44.

From a flow standpoint, it will be appreciated that an initial air flow, represented by arrow 50, enters gas turbine engine 10 through an inlet 52. Air flow 50 passes through fan blades 44 and splits into a first compressed air flow (represented by arrow 54) that moves through the fan casing 40 and a second compressed air flow (represented by arrow 56) which enters booster compressor 22. The pressure of second compressed air flow 56 is increased and enters high pressure compressor 24, as represented by arrow 58. After mixing with fuel and being combusted in combustor 26, combustion products 46 exit combustor 26 and flow through first turbine 28. Combustion products 46 then flow through second turbine 32 and exit exhaust nozzle 38 to provide thrust for gas turbine engine 10.

Many of the engine components may be fabricated in several pieces, due to complex geometries, and are subsequently joined together. These components may also be directly subjected to hot combustion gases during operation of the engine 10 and thus have very demanding material requirements. Accordingly, the arcuate components of the engine 10 that are fabricated from ceramic matrix composites (CMCs), such as the turbine blades 27, 34, nozzles, combustor liners, and shrouds, such as shrouds 29, 36, may be fabricated in more than one piece and subsequently joined together. As previously stated, ceramic matrix composites (CMCs) are an attractive material for turbine applications, because CMCs have high temperature capability and are light weight.

In joining multiple CMC pieces, or subcomponents, such as a plurality of shroud segments, to form a complete component structure, such as a shroud, it is desirable to form joints that are damage tolerant and exhibit tough, graceful failure. If the mechanical joint that joints the multiple CMC subcomponents fails, it may result in a catastrophic failure of the component structure.

Of particular concern for these joints is that the bond line tends to be brittle in nature, which could lead to brittle failure of the joint. It has been established in the CMC art that this limitation can be addressed by keeping the stress in the bond low by controlling the surface area of the bond and by making use of simple woodworking type joints such as butt joints, lap joins, tongue and groove joints, mortise and tenon joints, as well as more elaborate sawtooth or stepped tapered joints. Alternatively, joints that contain a mechanical interlock of tough CMC sub-components have also demonstrated graceful failure. Conventional woodworking joints such as dovetail joints have been demonstrated. The above joints can be used to join CMC sub-components in two or three dimensions such as flat plates and "T" shapes. While many woodworking type joints can create a mechanical interlock between two CMC subcomponents, in order for the interlock to take advantage of the full toughness of the CMC, the interlocking feature must be oriented such that the reinforcing fibers would be required to break in order to fail the interlock. If the interlocking feature is oriented such that the joint can be liberated by failing one of the CMC subcomponents in the interlaminar direction, then toughness of the interlock may be limited by the interlaminar properties of the CMC. In general, the interlaminar strength and toughness of CMCs are significantly lower than the in-plane properties.

Figure 2:
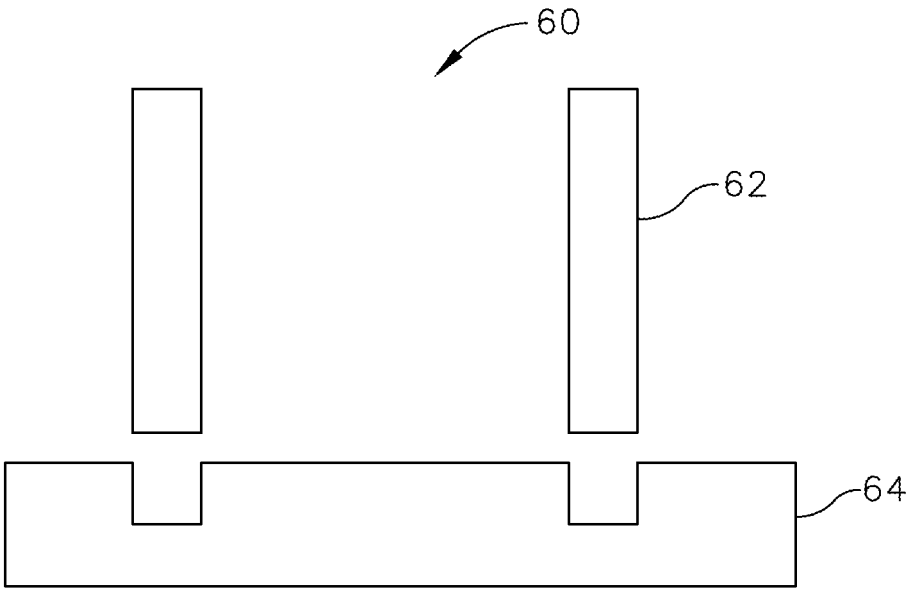
FIG. 2 is a schematic perspective view of an exemplary first subcomponent and a second subcomponent prior to joining, in accordance with one or more embodiments shown or described herein.

Referring now to FIG. 2, illustrated is cross-sectional view of a component 60, such as a portion of shroud 36 of FIG. 1, comprised of a first subcomponent 62 and a second subcomponent 64, illustrated in a non-joined state, and prior to joining to form the complete component structure. In an embodiment, the first subcomponent 62 and the second subcomponent 64 when joined form at least a portion of a high temperature mechanical system component. In an embodiment, the first and second subcomponents 62, 64 are shroud segments. In an alternate embodiment, the first subcomponent 62 and the second subcomponent 64 when joined may form at least a portion of an airfoil, a blade, a combustion chamber liner, or similar component of a gas turbine engine.

In this particular embodiment, the first subcomponent 62 and second subcomponents are constructed from a ceramic matrix composite (CMC) material of a known type. In an alternate embodiment, one of the first or the second subcomponents is formed of a ceramic matrix composite (CMC) material of a known type, while the other of the first or the second subcomponent is formed of a monolithic ceramic material. Accordingly, the component structure may include one CMC subcomponent and one monolithic ceramic subcomponent, or both subcomponents may be of a ceramic matrix composite (CMC) material.

Monolithic ceramics, such as SiC are typically brittle materials. The stress strain curve for such a material is generally a straight line that terminates when the sample fractures. The failure stress is often dictated by the presence of flaws and failure occurs by rapid crack growth from a critical flaw. The abrupt failure is sometimes referred to as brittle or catastrophic failure. While the strength and failure strain of the ceramic are flaw dependent, it is not uncommon for failure strains to be on the order of ~0.1%.

Generally, CMC materials include a high strength ceramic type fiber, such as Hi-Nicalon™ Type S manufactured by COI Ceramics, Inc. The fiber is embedded in a ceramic type matrix, such as SiC or SiC that contains residual free silicon. In the example of a SiC—SiC composite, where SiC fiber reinforces a SiC matrix, an interface coating such as Boron Nitride is typically applied to the fiber. This coating allows the fiber to debond from the matrix and slide in the vicinity of a matrix crack. A stress-strain curve for the fast fracture of a SiC—SiC composite generally has an initial linear elastic portion where the stress and strain are proportional to each other. As the load is increased, eventually the matrix will crack. In a well-made composite, the crack will be bridged by the reinforcing fiber. As the load on the composite is further increased, additional matrix cracks will form, and these cracks will also be bridged by the fibers. As the matrix cracks, it sheds load to the fibers and the stress strain curve becomes non-linear. The onset of non-linear stress-strain behavior is commonly referred to as the proportional limit or the matrix cracking stress. The bridging fibers impart toughness to the composite as they debond from the matrix and slide in the vicinity of the matrix cracks. At the location of a through crack, the fibers carry all of the load that is applied to the composite. Eventually, the load is great enough that the fibers fail, which leads to composite failure. The ability of the CMC to carry load after matrix cracking is often referred to as graceful failure. The damage tolerance exhibited by CMCs makes them desirable over monolithic ceramics that fail catastrophically.

CMC materials are orthotropic to at least some degree, i.e. the material's tensile strength in the direction parallel to the length of the fibers (the fiber direction, or 0 degree direction) is stronger than the tensile strength in the perpendicular directions (the 90 degree, cross ply or the interlaminar direction) as well as in the interlaminar or through thickness direction). Physical properties such as modulus and Poisson's ratio also differ with respect to fiber orientation. Most composites have fibers oriented in multiple directions. For example, in the prepreg MI SiC—SiSiC CMC, the architecture is comprised of layers, or plies, of unidirectional fibers. A common architecture consists of alternating layers of 0 and 90 degree fibers, which imparts toughness in all directions in the plane of the fibers. This ply level architecture does not, however, have fibers that run in the through thickness or interlaminar direction. Consequently, the strength and toughness of this composite is lower in the interlaminar direction than in the in-plane directions.

CMCs exhibit tough behavior and graceful failure when matrix cracks are bridged by fibers. Of greatest concern herein is failure of a joint that is formed when two CMC material components are joined together, in response to an applied load. If the joint is loaded in a direction such that it can fail and separate without breaking fibers, then there is the potential for brittle, catastrophic failure of that joint. Alternatively, if a joint is loaded in a direction such that, after matrix cracking in the joint, fibers bridge the crack, then there is the potential tough, damage tolerant, graceful failure of the joint.

Referring now to FIGS. 3-22 illustrated are a plurality of mechanical joints that may be used in the joining of two or more subcomponents to form a larger component structure with varying strength results. As illustrated, each figure is depicted having a simplified block geometry and illustrated noting the linear direction of the fibers within the component, as linear fill lines. However, the fibers in individual plies may be oriented in any direction within the plane defined by the fill line as projected in and out of the page. In each of the embodiments disclosed herein, the described mechanical joints may be used to join a first CMC subcomponent, such as the first subcomponent 62 and a second CMC subcomponent, such as the second subcomponent 64 of FIG. 2, to form a larger or complete component structure, such as shroud 36 of FIG. 1. In alternate embodiments, either the first subcomponent 62 or the second subcomponent 64 may be comprised as a monolithic ceramic subcomponent. In each of the embodiments disclosed herein, the first subcomponent and the second subcomponent are shroud segments.

Figure 3:
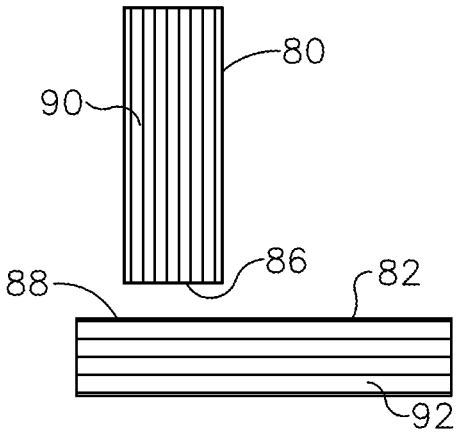
FIG. 3 is an embodiment of a first subcomponent and a second subcomponent in an unjoined state, in accordance with one or more embodiments shown or described herein.
Figure 4:
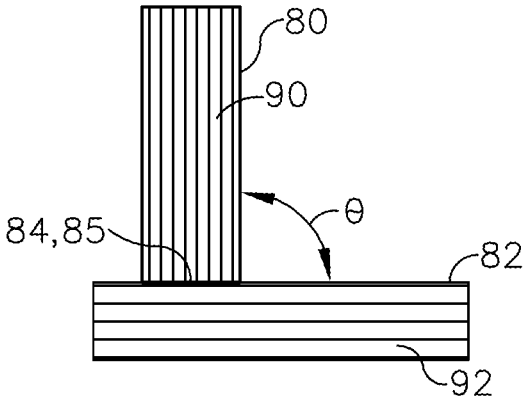
FIG. 4 illustrates the first subcomponent and the second subcomponent of FIG. 3 in a joined state, in accordance with one or more embodiments shown or described herein.

Referring more specifically to FIGS. 3 and 4, illustrated is a first subcomponent 80 and a second subcomponent 82, in accordance with an embodiment disclosed herein. In the illustrated embodiments, the first subcomponent 80 is formed of a ceramic matrix composite (CMC) including reinforcing fibers embedded in a matrix. The second subcomponent 82 is also formed of a ceramic matrix composite (CMC) including reinforcing fibers embedded in a matrix. In an alternate embodiment, either the first subcomponent 80 or the second subcomponent 82 is formed as a ceramic monolithic subcomponent. The first CMC subcomponent 80 and the second CMC subcomponent 82 are illustrated in an unjoined state in FIG. 3 and a joined state in FIG. 4. As best illustrated in FIG. 4, the first CMC subcomponent 80 and the second CMC subcomponent 82 are illustrated joined one to the other at a joint 84. In this particular embodiment, joint 84 is configured as a typical woodworking butt joint 85. More particularly, the first CMC subcomponent 80 and the second CMC subcomponent 82 are configured where a surface 86 of the first CMC subcomponent 80 and a surface 88 of the second CMC subcomponent 82 are positioned abutting at a substantially right angle 'θ'. As a result, a plurality of fibers 90 forming the first CMC subcomponent 80 and a plurality of fibers 92 forming the second CMC subcomponent 82 are also oriented at substantially right angles relative to one another. In this particular embodiment, subcomponents 80 and 82 are not connected by fibers as none of the fibers 90 or 92 bridge the joint. Thus a crack propagating along the joint plane would not be bridged by the fibers 90 or fibers 92. In an alternate embodiment, the fibers are oriented in one or more directions within the plane of the first subcomponent 80. For example, a first half of the fibers are oriented along a length, and a second half of the fibers are oriented along a width. In another embodiment, the fibers are oriented at angles to the length, yet in the plane of the subcomponent.

Figure 5:
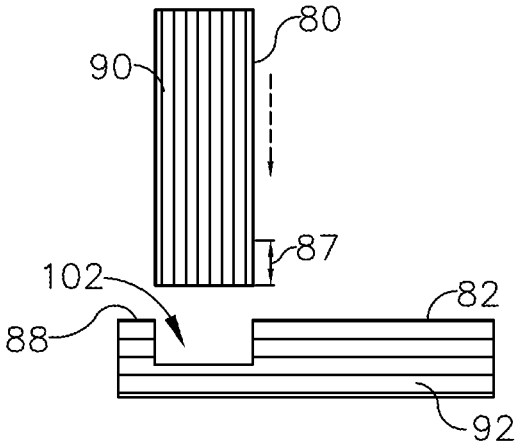
FIG. 5 is an embodiment of a first subcomponent and a second subcomponent in an unjoined state, in accordance with one or more embodiments shown or described herein.
Figure 6:
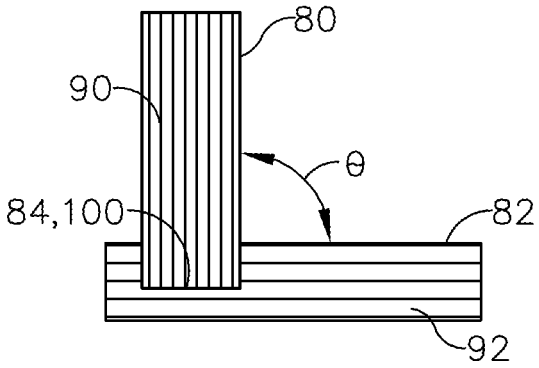
FIG. 6 illustrates the first subcomponent and the second subcomponent of FIG. 5 in a joined state, including an interlocking mechanical joint, in accordance with one or more embodiments shown or described herein.

Referring now to FIGS. 5 and 6, illustrated is another mechanical joint for joining a plurality of subcomponents. It should be understood that like elements are provided with like numbers throughout the embodiments of FIGS. 3-22 disclosed herein. FIG. 5 illustrates a first CMC subcomponent 80 and a second CMC subcomponent 82 in an unjoined state. As previously described, in an alternate embodiment, either the first subcomponent 80 or the second subcomponent 82 may be formed as a monolithic ceramic component. FIG. 6 illustrates a first CMC subcomponent 80 and a second CMC subcomponent 82 in a joined state. As best illustrated in FIG. 6, the first CMC subcomponent 80 and the second CMC subcomponent 82 are joined one to the other at a joint 84. In this particular embodiment, joint 84 is configured as a typical woodworking dado joint 100. The dado joint 100 is typically formed by cutting a groove 102 across a width of the second CMC subcomponent 82 (the groove 102 extending into and out of the page in FIGS. 5 and 6). When the groove 102, or dado, runs across the full width of the second CMC subcomponent 92, it is commonly referred to as a through dado. When the groove 102, or dado, runs across only a partial width of the second CMC subcomponent 92 it is commonly referred to as a stopped dado. In a stopped dado, the groove 102 is stopped from an edge, typically by an amount equal to a thickness of the second CMC subcomponent 92. In the embodiment of FIGS. 5 and 6, the groove 102 may be configured as either a through dado or a stopped dado. In the illustrated embodiment, the first CMC subcomponent 80 and the second CMC subcomponent 82 are configured where a portion 87 of the first CMC subcomponent 80 is positioned, within the groove 102 defined in the second CMC subcomponent 82, forming the dado joint 100. As illustrated, in this particular embodiment, the first and second CMC subcomponents 80, 82 are positioned at a substantially right angle 'θ'. As a result, a plurality of fibers 90 forming the first CMC subcomponent 80 and a plurality of fibers 92 forming the second CMC subcomponent 82 are also oriented at substantially right angles relative to one another. In this particular embodiment, subcomponents 80 and 82 are not connected by fibers as none of the fibers 90 or 92 bridge the joint. While this joint can be strong when loaded normal to subcomponent 80, if the subcomponents 80 and 82 are bonded at the joint 100 by a brittle material such as silicon or silicon carbide, joint 100 could fail in the bond in a brittle manner.

Figure 7:
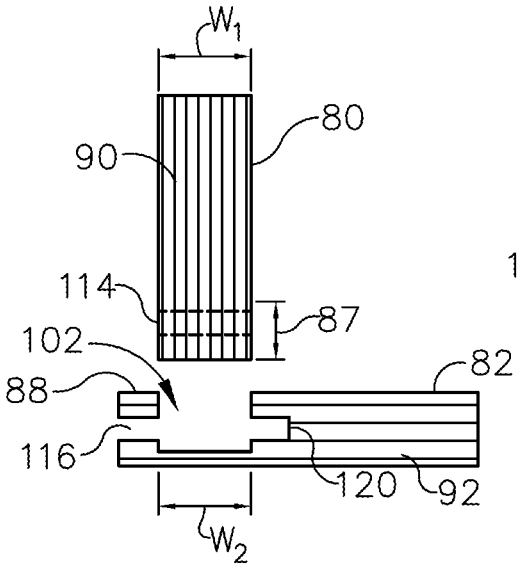
FIG. 7 is an embodiment of a first subcomponent and a second subcomponent in an unjoined state, in accordance with one or more embodiments shown or described herein.
Figure 8:
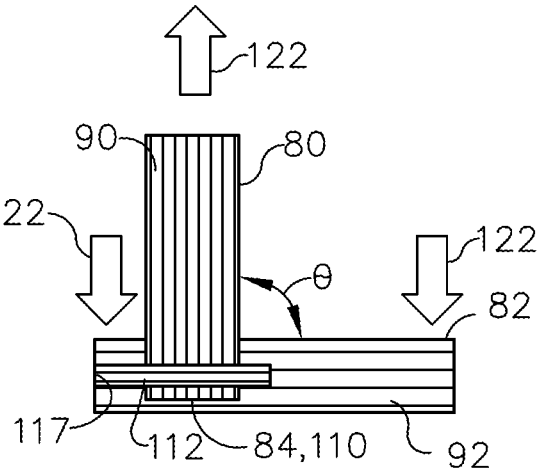
FIG. 8 illustrates the first subcomponent and the second subcomponent of FIG. 7 in a joined state, including a reinforced interlocking mechanical joint, in accordance with one or more embodiments shown or described herein.

Referring now to FIGS. 7 and 8, illustrated is another mechanical joint for joining a plurality of subcomponents. FIG. 7 illustrates a first CMC subcomponent 80 and a second CMC subcomponent 82 in an unjoined state. As previously described, in an alternate embodiment, either the first subcomponent 80 or the second subcomponent 82 may be formed as a monolithic ceramic component. FIG. 8 illustrates a first CMC subcomponent 80 and a second CMC subcomponent 82 in a joined state. As best illustrated in FIG. 8, the first CMC subcomponent 80 and the second CMC subcomponent 82 are joined one to the other at a joint 84. Similar to the previous embodiment of FIGS. 5 and 6, in this particular embodiment, joint 84 is configured as a typical woodworking dado joint 110 cut into the second CMC subcomponent 92 (the groove 102 extending into and out of the page in FIGS. 7 and 8). In an alternate embodiment, the groove 102 may be configured as a stopped dado joint. In contrast to the embodiment of FIGS. 5 and 6, in this particular embodiment, the dado joint 110 is reinforced with a CMC pin 112 to provide a toughened or stronger joint between the first subcomponent 80 and the second subcomponent. The toughened joint will be more able to withstand applied forces exerted thereon the first subcomponent 80 and the second subcomponent 90, as described herein. To provide for such CMC pin 112, the first CMC subcomponent 80 has formed therein a receiving opening 114, extending across an interlaminar width "$W_1$" of the first CMC subcomponent 80. Similarly, the second CMC subcomponent 82 has formed therein a cooperative receiving opening 116, extending across the width "$W_2$" of the groove 102 and extending into the second CMC subcomponent 82. For positioning of the CMC pin 112 in the receiving openings 114, 116, the first CMC subcomponent 80 is positioned within the groove 102 of the second CMC subcomponent 82 and the CMC pin 112 is inserted from one side of the second CMC subcomponent 82 into the receiving openings 114, 116 with a sliding fit until a front end part 118 of the CMC pin 112 strikes against an abutment 120 of the receiving opening 116 when the CMC pin 112 has reached the optimal position within the second CMC subcomponent 82.

In the illustrated embodiment of FIGS. 7 and 8, the first CMC subcomponent 80 and the second CMC subcomponent 82 are configured where a portion 87 of the first CMC subcomponent 80 is positioned, within the groove 102 defined in the second CMC subcomponent 82, forming the dado joint 110. As illustrated, similar to the previous embodiment, the first and second CMC subcomponents 80, 82 are positioned at a substantially right angle 'θ'. As a result, a plurality of fibers 90 forming the first CMC subcomponent 80 and a plurality of fibers 92 forming the second CMC subcomponent 82 are also oriented at substantially right angles relative to one another. In addition, a plurality of fibers 117 that comprise the CMC pin 112 are oriented in the generally same orientation as the second subcomponent 82 In this particular embodiment, in the presence of applied loads, as indicated by directional arrow 122, the fibers 117 in the CMC pin 112 would need to be broken in order to cause failure of the joint 110 and thus separation of the first subcomponent 80 and the second subcomponent 82. The reinforcing of the joint 84 with the CMC pin 112 provides a joint between two CMC material subcomponents that is very durable in the direction of the applied loads 122. The formation of the receiving opening 116 necessitates the removal/displacement of a portion of the fibers 92 in the second CMC subcomponent 82. This may result in a property debit in that direction.

Figure 9:
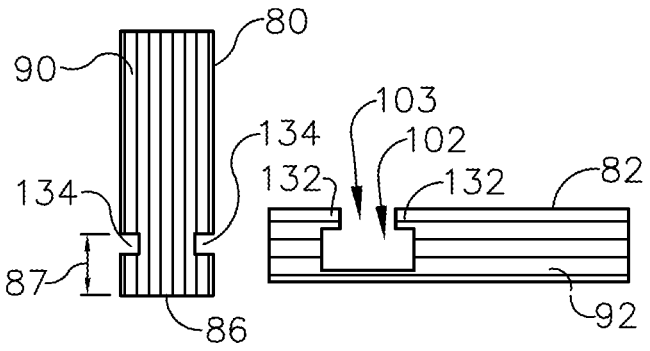
FIG. 9 is an embodiment of a first subcomponent and a second subcomponent in an unjoined state, in accordance with one or more embodiments shown or described herein.
Figure 10:
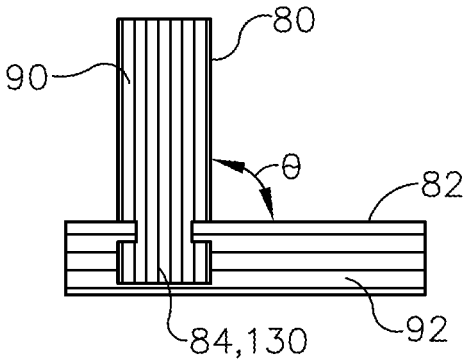
FIG. 10 illustrates the first subcomponent and the second subcomponent of FIG. 9 in a joined state, including an interlocking mechanical joint, in accordance with one or more embodiments shown or described herein.
Figure 11:
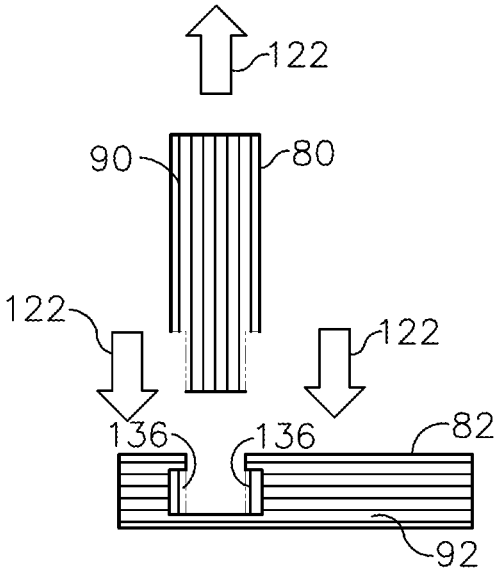
FIG. 11 is the interlocking mechanical joint of FIG. 10, when under the influence of applied forces, in accordance with one or more embodiments shown or described herein.

Referring now to FIGS. 9-11, illustrated is another mechanical joint for joining a plurality of subcomponents. FIG. 9 illustrates a first CMC subcomponent 80 and a second CMC subcomponent 82 in an unjoined state. As previously described, in an alternate embodiment, either the first subcomponent 80 or the second subcomponent 82 may be formed as a monolithic ceramic component. FIG. 10 illustrates a first CMC subcomponent 80 and a second CMC subcomponent 82 in a joined state. FIG. 11 illustrates a first CMC subcomponent 80 and a second CMC subcomponent 82 in response to an applied force. As best illustrated in FIG. 10, the first CMC subcomponent 80 and the second CMC subcomponent 82 are joined one to the other at a joint 84. In this particular embodiment, the joint 84 is configured as a woodworking interlocking rabbet joint, or combination rabbet and dado joint, 130. More particularly, the interlocking rabbet joint 130 includes a groove 102 cut across a width of the second CMC subcomponent 82 (the groove 102 extending into and out of the page in FIGS. 9-11). In contrast to the embodiments of FIGS. 5-8, in this particular embodiment, the interlocking rabbet joint 130, and more particularly, the groove 102 further includes a plurality of small rabbet joints 132 formed on either side of the groove 102, proximate an opening 103 of the groove 102. Cooperating dado notches 134 are formed in the first CMC subcomponent 80. During assembly, the first CMC subcomponent 82 is slidingly positioned in cooperative engagement with the second CMC subcomponent 82, by sliding the first CMC subcomponent 80 in a direction into/out of the page.

In the illustrated embodiment of FIGS. 9-11, the first CMC subcomponent 80 and the second CMC subcomponent 82 are configured where a portion 87 of the first CMC subcomponent 80 is positioned, within the groove 102, defined in the second CMC subcomponent 82, so as to provide cooperative engagement of a respective rabbet joint 132 of the second CMC subcomponent 82 with a respective notch 134 formed in the first CMC subcomponent 80. These interlocking features form the interlocked rabbet joint 130 upon assembly. As illustrated, similar to the previous embodiment, the first and second CMC subcomponents 80, 82 are positioned at a substantially right angle θ. In another embodiment, the first and second CMC subcomponents 80, 82 are positioned at an angle that is not a right angle. As a result, a plurality of fibers 90 forming the first CMC subcomponent 80 and a plurality of fibers 92 forming the second CMC subcomponent 82 are also oriented at substantially right angles relative to one another.

Referring more particularly to FIG. 11, in this particular embodiment, in the presence of an applied load, as indicated by directional arrows 122, the fibers 90, 92 in the first and second CMC subcomponents 80, 82, respectively, do not need to break for the joint 130 to fail and liberate the first CMC subcomponent 80 from the second CMC subcomponent 82. For failure of the interlocking rabbet joint 130 to occur, only the first CMC subcomponent 80 needs to shear in an interlaminar direction. Shearing in this direction, and failing of the joint 130 results in portions 136 of the CMC fibers 90 of the first CMC subcomponent 80 to remain within the rabbeted groove 102.

Figure 12:
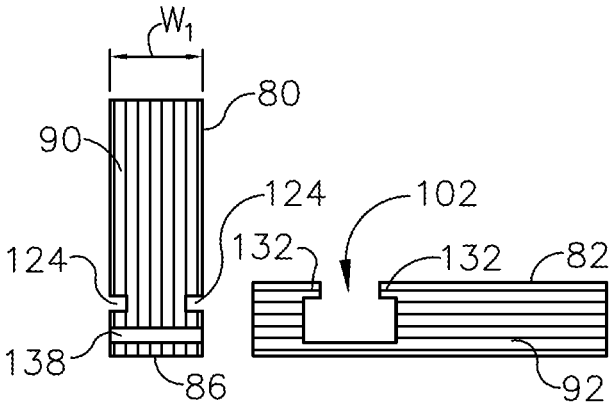
FIG. 12 is an embodiment of a first subcomponent and a second subcomponent in an unjoined state, in accordance with one or more embodiments shown or described herein.
Figure 13:
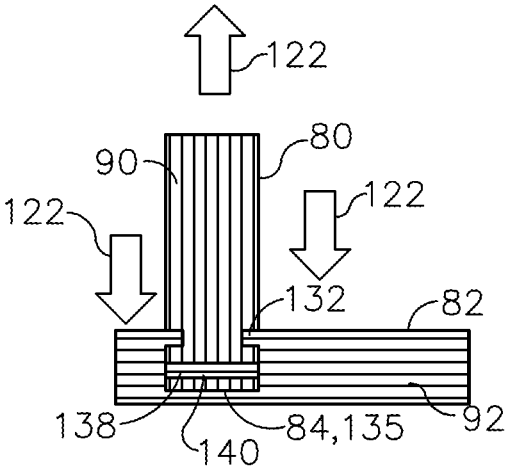
FIG. 13 illustrates the first subcomponent and the second subcomponent of FIG. 12 in a joined state, including a reinforced interlocking mechanical joint, in accordance with one or more embodiments shown or described herein.
Figure 14:
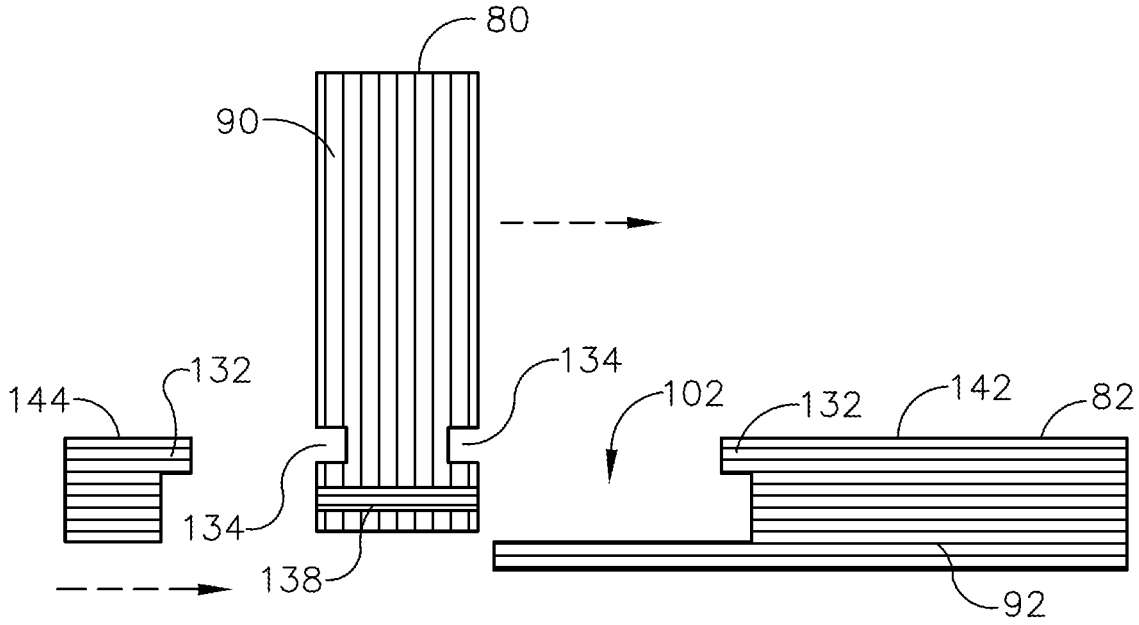
FIG. 14 illustrates a method of assembling the first subcomponent and the second subcomponent of FIG. 13 to form the reinforced interlocking mechanical joint, in accordance with one or more embodiments shown or described herein.

To provide strength or toughness to the rabbeted groove joint, such as joint 130 of FIGS. 9-11, a CMC pin may be added, as best illustrated in FIG. 12. Accordingly, referring now to FIGS. 12-14, illustrated is another mechanical joint for joining a plurality of CMC components. FIG. 12 illustrates a first CMC subcomponent 80 and a second CMC subcomponent 82 in an unjoined state. FIG. 13 illustrates a first CMC subcomponent 80 and a second CMC subcomponent 82 in a joined state. FIG. 14 illustrates a first CMC subcomponent 80 and a second CMC subcomponent during the joining process. As best illustrated in FIG. 13, the first CMC subcomponent 80 and the second CMC subcomponent 82 are configured and joined one to the other at a joint 84, and more particularly at an interlocking rabbet joint 130, generally similar to the embodiment of FIGS. 9-11. In this particular embodiment, the interlocking rabbet joint 13, and more particularly the first CMC subcomponent 80, is further strengthened, or toughened, by the inclusion of a CMC pin 138 positioned across a width "$W_1$" of the first CMC subcomponent 80. In contrast to the CMC pin 118 of FIG. 8, the CMC pin 138 extends only across width $W_1$ of the first CMC subcomponent 80 so as to strengthen the portion of the first CMC subcomponent 80 that was susceptible to interlaminar shear, in response to applied loads 122, as described in FIGS. 9-11. In an embodiment, the first CMC subcomponent 80 includes a receiving opening (not shown), generally similar to receiving opening 114 of FIG. 7. In this particular embodiment, the CMC pin 138 is inserted into the first CMC subcomponent 80 prior to assembly with the second CMC subcomponent 82.

Referring to FIG. 13, in this particular embodiment, in the presence of applied loads, as indicated by directional arrows 122, for the joint 130 to fail, a plurality of fibers 140 that comprise the CMC pin 138 would need to break to liberate the first CMC subcomponent 80 from the second CMC subcomponent 82. Alternatively, the joint 130 would fail if the CMC fibers 92 in the interlocking feature, and more particularly in the rabbet joints 132 of the second CMC subcomponent 90 break so as to liberate the first CMC subcomponent 80 from the second CMC subcomponent 82.

As previously indicated with respect to FIGS. 9-10, during assembly, the first CMC subcomponent 82 may be slidingly positioned in cooperative engagement with the second CMC subcomponent 82, by sliding the first CMC subcomponent 80 in a direction into/out of the page. In a turbine shroud embodiment, it is noted that the first CMC subcomponent 80 may be a straight extrusion in and out of the page, or it may be curved in and out of the page. Alternatively, as illustrated in FIG. 14, in an embodiment, the second CMC subcomponent 82 may be configured as two pieces, whereby the first CMC subcomponent 82 is slidingly engaged, as indicated by a dashed arrow, into a first piece 142 of the second CMC subcomponent 82, so as to engage each of the one or more small rabbet joints 132 with the cooperating dado notch 134 formed in the first CMC subcomponent 82. A second piece 144 of the second CMC subcomponent 92 is thereafter slidingly moved to provide engagement of each the one or more rabbet joints 132 of the second piece 144 with another of the cooperative dado notches 134 of the first CMC subcomponent 80.

Figure 15:
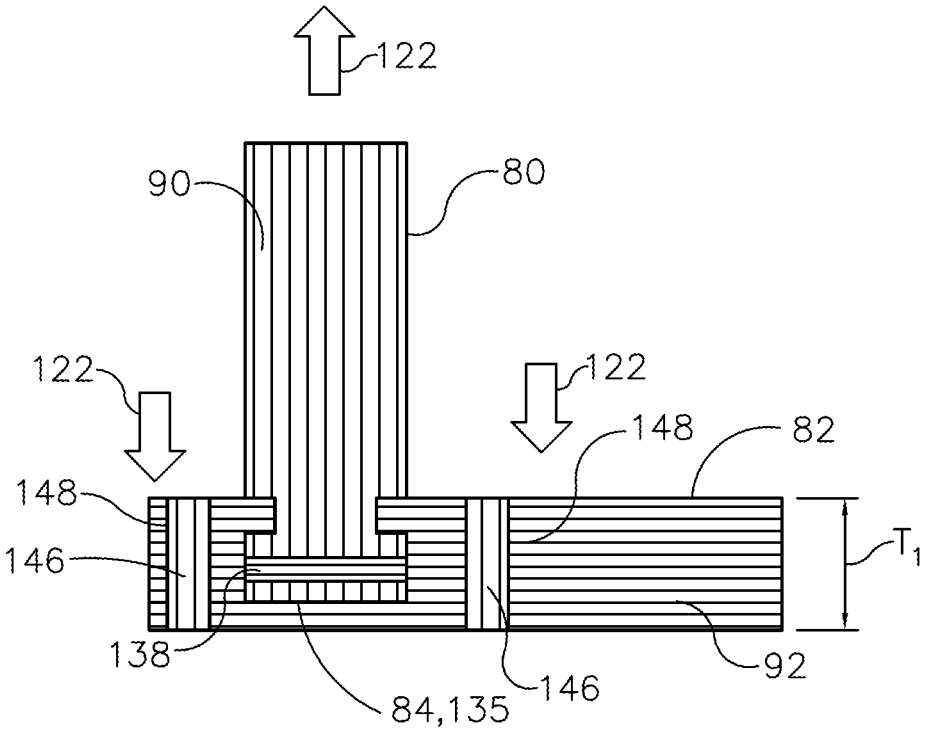
FIG. 15 illustrates the first subcomponent and a second subcomponent of FIG. 13 in a joined state, including the reinforced interlocking mechanical joint and additional reinforcing interlaminar pins, in accordance with one or more embodiments shown or described herein.

In yet another embodiment, as best illustrated in FIG. 15, additional CMC pins 146 may be included in the overall structure, extending through a thickness "$T_1$" of the second CMC subcomponent 82. In an embodiment, the additional CMC pins 146 may extend only partially through the thickness "$T_1$" of the second CMC subcomponent 82. The inclusion of the additional CMC pins 146 prevents interlaminar failure of the second CMC subcomponent 82 when subjected to loads 122 as previously described.

Figure 16:
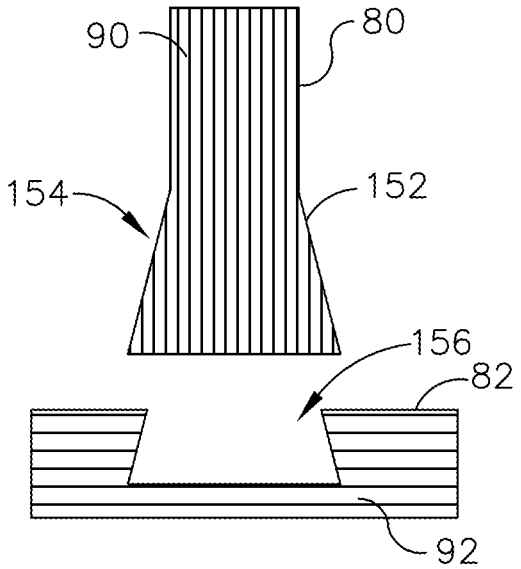
FIG. 16 is an embodiment of a first subcomponent and a second subcomponent in an unjoined state, in accordance with one or more embodiments shown or described herein.
Figure 17:
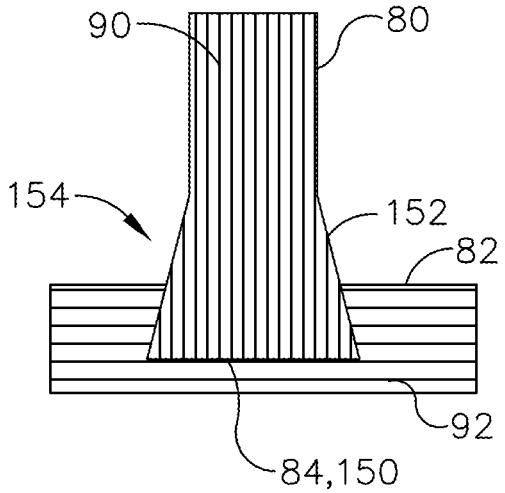
FIG. 17 illustrates the first subcomponent and the second subcomponent of FIG. 16 in a joined state, including an interlocking mechanical joint, in accordance with one or more embodiments shown or described herein.

Referring now to FIGS. 16-22, illustrated is another mechanical joint for joining a plurality of subcomponents. FIG. 16 illustrates a first CMC subcomponent 80 and a second CMC subcomponent 82 in an unjoined state. As previously described, in an alternate embodiment, either the first subcomponent 80 or the second subcomponent 82 may be formed as a monolithic ceramic component. FIG. 17 illustrates a first CMC subcomponent 80 and a second CMC subcomponent 82 in a joined state. As best illustrated in FIG. 17, the first CMC subcomponent 80 and the second CMC subcomponent 82 are joined one to the other at a joint 84. In this particular embodiment, the joint 84 is configured as a woodworking interlocking dovetail joint 150. More particularly, the interlocking dovetail joint 150 comprises a plurality of sloping sides 152 defined in the first CMC subcomponent 80, defining a tail 154, and a groove 156 defined in the second CMC subcomponent 82 (the tail 154 and groove 156 extending into and out of the page in FIGS. 16-22). During assembly, the first CMC subcomponent 80 is slidingly positioned in cooperative engagement with the second CMC subcomponent 82, by sliding the first CMC subcomponent 80, and more particularly the tail 154, into the groove 156 in a direction into/out of the page.

In the illustrated embodiment of FIGS. 16-22, the first CMC subcomponent 80 and the second CMC subcomponent 82 are configured where the tail 154 of the first CMC subcomponent 80 is positioned, within the groove 156, defined in the second CMC subcomponent 82, so as to provide cooperative engagement of the first CMC subcomponent 80 with the second CMC subcomponent 82. These interlocking features form the interlocked dovetail joint 150 upon assembly. As illustrated, similar to the previous embodiments, the first and second CMC subcomponents 80, 82, and more particularly, the plurality of fibers 90 of each, are positioned at a substantially right angle θ relative to one another. In another embodiment, the first and second CMC subcomponents 80, 82, and thus the plurality of fibers 90 of each, are positioned at an angle that is not a right angle.

Figure 18:
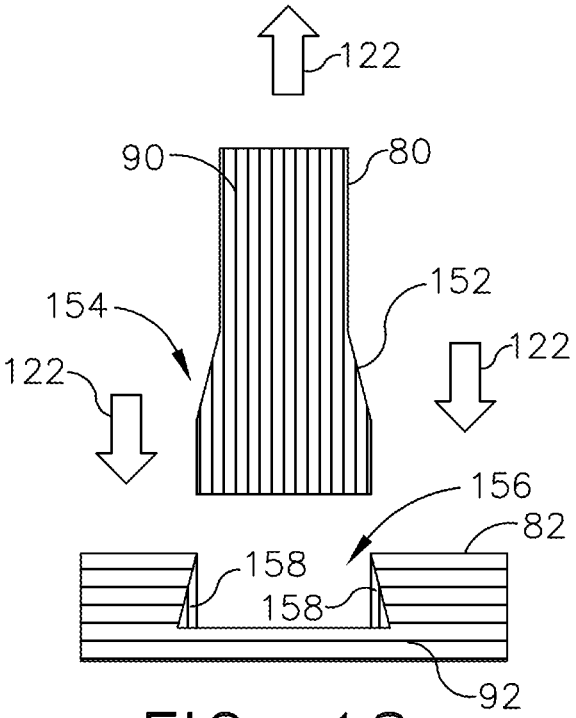
FIG. 18 is the interlocking mechanical joint of FIG. 17, when under the influence of applied forces, in accordance with one or more embodiments shown or described herein.

Referring more particularly to FIG. 18, in this particular embodiment, in the presence of an applied load, as indicated by directional arrows 122, the fibers 90, 92 in the first and second CMC subcomponents 80, 82, respectively, do not need to break for the joint 150 to fail and liberate the first CMC subcomponent 80 from the second CMC subcomponent 82. For failure of the dovetail joint 150 to occur, only the first CMC subcomponent 80 needs to shear in an interlaminar direction. Shearing in this direction, and failing of the joint 150 results in portions 158 of the CMC fibers 90 of the first CMC subcomponent 80 to remain within the groove 156.

Figure 19:
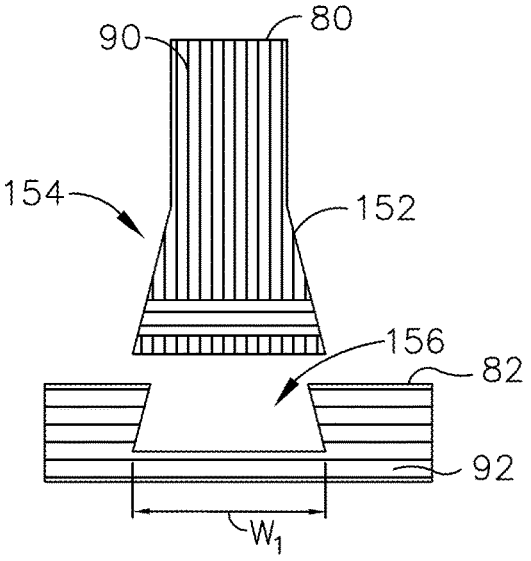
FIG. 19 is an embodiment of a first subcomponent and a second subcomponent in an unjoined state, in accordance with one or more embodiments shown or described herein.
Figure 20:
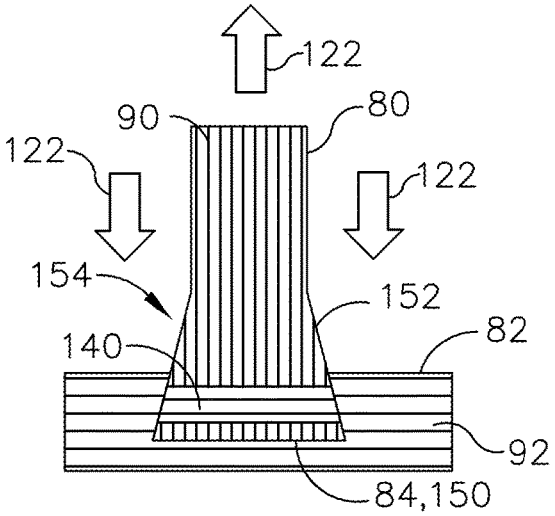
FIG. 20 illustrates the first subcomponent and the second subcomponent of FIG. 19 in a joined state, including a reinforced interlocking mechanical joint, in accordance with one or more embodiments shown or described herein.
Figure 21:
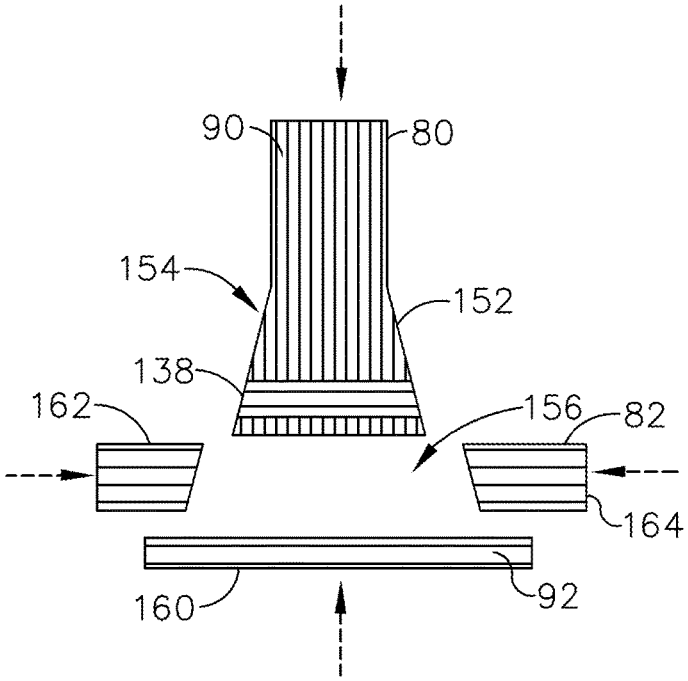
FIG. 21 illustrates a method of assembling the first subcomponent and the second subcomponent of FIG. 20 to form the reinforced interlocking mechanical joint, in accordance with one or more embodiments shown or described herein.
Figure 22:
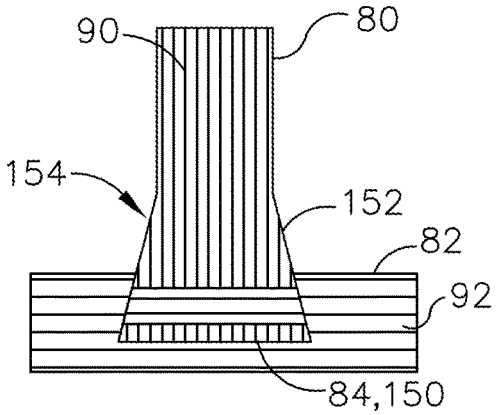
FIG. 22 illustrates the first subcomponent and a second subcomponent of FIG. 21 in a joined state, including the reinforced interlocking mechanical joint and an additional reinforcing interlaminar pin, in accordance with one or more embodiments shown or described herein.

To provide strength to the dovetail joint 150 of FIGS. 15-22, a CMC pin may be added, as best illustrated in FIGS. 19-22. Accordingly, illustrated is another mechanical joint for joining a plurality of CMC components. FIGS. 19 and 21 illustrate a first CMC subcomponent 80 and a second CMC subcomponent 82 in an unjoined state. FIGS. 20 and 22 illustrate a first CMC subcomponent 80 and a second CMC subcomponent 82 in a joined state. As best illustrated in FIGS. 20 and 22, the first CMC subcomponent 80 and the second CMC subcomponent 82 are configured and joined one to the other at a joint 84, and more particularly at an interlocking dovetail joint 150, generally similar to the embodiment of FIGS. 16-18. In this particular embodiment, the interlocking dovetail joint 150, and more particularly the first CMC subcomponent 80, is further strengthened, or toughened, by the inclusion of a CMC pin 138 positioned across an interlaminar width "W1" of the tail 154 of the first CMC subcomponent 80. In contrast to the CMC pin 118 of FIG. 8, the CMC pin 138 extends only across the interlaminar width W1 of the first CMC subcomponent 80 so as to strengthen the portion of the first CMC subcomponent 80 that was susceptible to interlaminar shear, in response to applied loads 122, as described in FIG. 18. In an embodiment, the first CMC subcomponent 80 includes a receiving opening (not shown), generally similar to receiving opening 114 of FIG. 7. In this particular embodiment, the CMC pin 138 is inserted into the first CMC subcomponent 80 prior to assembly with the second CMC subcomponent 82.

Referring to FIG. 20, in the presence of applied loads, as indicated by directional arrows 122, for the joint 150 to fail, a plurality of fibers 140 that comprise the CMC pin 138 would need to break to liberate the first CMC subcomponent 80 from the second CMC subcomponent 82.

As previously indicated with respect to FIGS. 16 and 17, during assembly, the first CMC subcomponent 80 may be slidingly positioned in cooperative engagement with the second CMC subcomponent 82, by sliding the first CMC subcomponent 80 in a direction into/out of the page. In a turbine shroud embodiment, it is noted that the first CMC subcomponent 80 may be a straight extrusion in and out of the page, or it may be curved in and out of the page.

Alternatively, as illustrated in FIGS. 21 and 22, in an embodiment, the second CMC subcomponent 82 may be configured as multiple pieces, whereby the first CMC subcomponent 82 is engaged within a first piece 160 of the second CMC subcomponent 82. A second piece 162 and third piece 164 of the second CMC subcomponent 92 are thereafter slidingly moved to define the groove 156 in the second CMC subcomponent 82 and provide engagement of tail 154 of the first CMC subcomponent 80 as best illustrated in FIG. 22.

Figure 23:
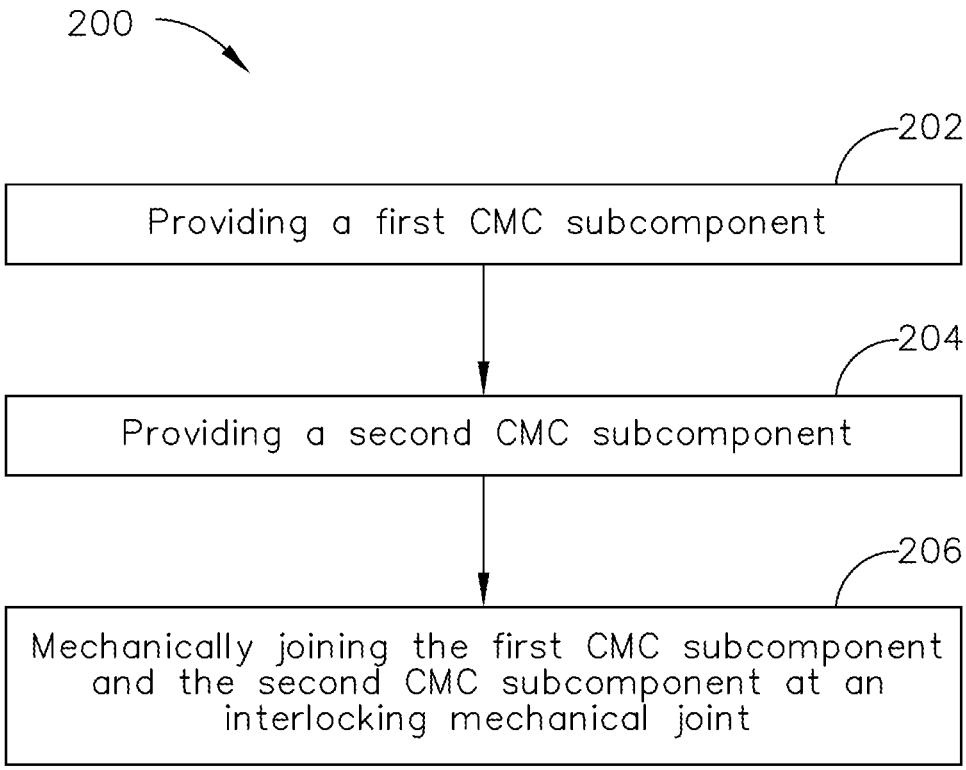
FIG. 23 is a flowchart illustrating the steps in a manufacturing method, in accordance with one or more embodiments shown or described herein.

FIG. 23 is a flowchart of a method 200 of forming a ceramic matrix composite (CMC) component, in accordance with an embodiment disclosed herein. As shown in FIG. 23, the method 200 comprises the providing a first CMC subcomponent comprised of a ceramic matrix composite (CMC) including reinforcing fibers embedded in a matrix, in a step 202. As previously described, the plurality of reinforcing fibers are oriented substantially along a length of the first CMC subcomponent.

Next, the method 200 comprises the providing a second CMC subcomponent comprised of a ceramic matrix composite (CMC) including reinforcing fibers embedded in a matrix, in a step 204. As previously described, the plurality of reinforcing fibers are oriented along a length of the second CMC subcomponent.

The first CMC subcomponent and the second CMC subcomponent are next mechanically joined at an interlocking mechanical joint, in a step 206, to form the composite material component. The interlocking mechanical joint is one of a dado joint, a pinned dado joint, an interlocking rabbet joint, or a pinned interlocking rabbet joint or a dovetail joint. The step of mechanically joining the first CMC subcomponent and the second CMC subcomponent at the interlocking mechanical joint further comprises disposing at least one ceramic matrix composite (CMC) pin in a manner to prevent failure of the interlocking mechanical joint. The first CMC subcomponent and the second CMC subcomponent are joined in a manner to orient the reinforcing fibers of the first CMC subcomponent substantially orthogonal to the reinforcing fibers of the second CMC subcomponent. The interlocking mechanical joint is formed during a CMC manufacture process in one of an autoclave (AC) state, a burn out (BO) state, or melt infiltration (MI) state. In an embodiment, the ceramic matrix composite (CMC) component is a gas turbine component.

Accordingly, described is the use of mechanical joints to join multiple subcomponents, and more specifically the use of mechanical interlocking joints, including one or more optional reinforcing CMC pins, wherein the ceramic fibers that comprise the subcomponents or the reinforcing CMC pin would need to be broken in order to separate the joint in an expected loading direction. While some existing interlocking joints behave in this manner, others do not and could fail by shearing the interlocking feature in the interlaminar direction. The interlocking mechanical joints as described herein provide for reinforcement of the subcomponents that make up the joint, without reinforcing the joint itself. This approach can greatly simplify the manufacturing process and prevent the property debits that can occur in a direction orthogonal to the reinforcement. It should be understood that additional types of mechanical joints are contemplated for joining the first subcomponent and the second subcomponent, including, but not limited to, cross-lapped joints, dovetail joints, doweled joints, miter joints, mortise and tenon joints, splined joints tongue and groove joints, or the like. The interlocking mechanical joining of the subcomponents as described herein can be done in the layed up state prior to lamination, in the autoclave (AC), burn out (BO), or melt infiltration (MI) state or combinations thereof of the CMC manufacture process. For joints made in the MI state, the joint maybe left "unglued". These joints may also be easier to repair. In an embodiment, simple shapes, such as flat panels, can be green machined (in autoclaved state) and assembled using woodworking type interlocking mechanical joints as described herein. In an embodiment, a CMC matrix precursor slurry (or variants thereof) may be used to "glue" the CMC subcomponents together. Final densification and bonding occurs in the MI state.

While the invention has been described in terms of one or more particular embodiments, it is apparent that other forms could be adopted by one skilled in the art. It is understood that in the method shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceramic composite material component comprising:

a first subcomponent comprised of a ceramic matrix composite (CMC) including reinforcing fibers embedded in a matrix, the reinforcing fibers of the first subcomponent extending in a first direction;

a second subcomponent comprise of a CMC including reinforcing fibers embedded in a matrix, the reinforcing fibers of the second subcomponent oriented in a second direction; and at least one interlocking mechanical joint joining the first subcomponent and the second subcomponent to form the ceramic composite material component, wherein the at least one interlocking mechanical joint comprises at least one groove defined in the second subcomponent and into which a portion of the first subcomponent is disposed, wherein the at least one interlocking mechanical joint joins the first subcomponent and the second subcomponent in a manner to orient the reinforcing fibers of the first subcomponent orthogonal to the reinforcing fibers of the second subcomponent;

wherein the at least one interlocking mechanical joint has a CMC pin that reinforces the first subcomponent and the second subcomponent, the CMC pin extending along the second direction, the CMC pin being disposed within an opening of the first subcomponent and within an opening of the second subcomponent, wherein the CMC pin comprises a plurality of fibers oriented in the second direction.

2. The ceramic composite material component of claim 1, wherein the ceramic composite material component is a gas turbine engine component.

3. The ceramic composite material component of claim 2, wherein the ceramic composite material component is a shroud segment.

4. The ceramic composite material component of claim 1, wherein the CMC pin extends more than an interlaminar width of the portion of the first subcomponent that is disposed in the at least one groove, the interlaminar width being a width of the first subcomponent that is orthogonal to the first direction.

5. The ceramic composite material component of claim 1, wherein the at least one interlocking mechanical joint further comprises one or more rabbet joints proximate an opening of the groove.

6. The ceramic composite material component of claim 5, wherein the interlocking mechanical joint further comprises one or more dado notches formed in the other of the first subcomponent or the second subcomponent, and wherein the one or more dado notches cooperate with the one or more rabbet joints to provide interlocking of the first subcomponent and the second subcomponent.

7. A method of forming the ceramic composite material component of claim 1 comprising a ceramic matrix component (CMC) component comprising:

providing a first subcomponent comprised of a CMC including reinforcing fibers embedded in a matrix, wherein the plurality of reinforcing fibers are oriented along a length of the first subcomponent, extending in a first direction;

providing a second subcomponent comprised of a CMC including reinforcing fibers embedded in a matrix, wherein the plurality of reinforcing fibers are oriented along a length of the second subcomponent, extending in a second direction, the second direction being orthogonal to the first direction;

disposing a portion of the first subcomponent into at least one groove defined in the second subcomponent; and mechanically joining the first subcomponent and the second subcomponent at an interlocking mechanical joint to form the CMC component, the at least one interlocking mechanical joint having a CMC pin that reinforces the first subcomponent and the second subcomponent, the CMC pin extending along the second direction, the CMC pin being disposed within an opening of the first subcomponent and within an opening of the second subcomponent, wherein the CMC pin comprises a plurality of fibers oriented in the second direction.

8. The method of claim 7, wherein the CMC component is a gas turbine component.

9. The method of claim 7, wherein mechanically joining the first subcomponent and the second subcomponent at the interlocking mechanical joint further comprises disposing at least CMC pin in a manner to prevent failure of the interlocking mechanical joint.

10. The method of claim 7, wherein the interlocking mechanical joint is formed during a CMC manufacture process in one of an autoclave (AC) state, a burn out (BO) state, or melt infiltration (MI) state.

11. The method of claim 7, wherein the interlocking mechanical joint includes direct bonding of the first subcomponent and the second subcomponent.

12. The ceramic composite material component of claim 4, wherein the CMC pin has a front end part that contacts an abutment of the opening of the second subcomponent.

13. The ceramic composite material component of claim 1, wherein the portion of the first subcomponent that is disposed in the at least one groove defines an abutment surface that is orthogonal to the first direction, the abutment surface making contact with the second subcomponent.

14. The ceramic composite material component of claim 1, wherein the groove extends in the second direction.

15. A ceramic composite material component comprising:

a first subcomponent comprised of a ceramic matrix composite (CMC) including reinforcing fibers embedded in a matrix, the reinforcing fibers of the first subcomponent extending in a first direction;

a second subcomponent comprised of one of a CMC including reinforcing fibers embedded in a matrix or a ceramic monolithic material; and at least one interlocking mechanical joint joining the first subcomponent and the second subcomponent to form the ceramic composite material component, the at least one interlocking mechanical joint joining the first subcomponent and the second subcomponent in a manner to orient the reinforcing fibers of the first subcomponent such that they extend towards the second subcomponent;

wherein the at least one interlocking mechanical joint comprises a groove defined in the second subcomponent and into which a portion of the first subcomponent is disposed, the groove being a through dado that extends across a full width of the second subcomponent, the full width being a width of the second subcomponent in a second direction, the second direction being orthogonal to the first direction, and wherein the at least one interlocking mechanical joint further comprises one or more rabbet joints proximate an opening of the groove.

16. The ceramic composite material component of claim 15, wherein the at least one interlocking mechanical joint has a CMC pin that reinforces the first subcomponent and the second subcomponent, the CMC pin extending along the second direction.

17. The ceramic composite material component of claim 15, wherein the ceramic composite material component is a shroud segment for a gas turbine engine.

* * * * *